US005601143A

United States Patent [19]

Binder

[11] Patent Number: 5,601,143

[45] Date of Patent: Feb. 11, 1997

[54] LABORATORY REGRIGERATOR, IN PARTICULAR A REFRIGERATED INCUBATOR

[76] Inventor: Peter M. Binder, Säntisstrasse 74A, 88662 Überlingen, Germany

[21] Appl. No.: 393,899

[22] Filed: Feb. 24, 1995

[30] Foreign Application Priority Data

Feb. 25, 1994 [DE] Germany ..... 44 06 145.5

[51] Int. Cl.[6] ..... F24C 7/06

[52] U.S. Cl. ..... 105/61; 165/64; 62/442

[58] Field of Search ..... 165/61, 64; 62/442, 62/446, 418

[56] References Cited

U.S. PATENT DOCUMENTS

| | | | |
|---|---|---|---|
| 4,884,626 | 12/1989 | Filipowski | 165/64 |
| 5,433,141 | 7/1995 | Mehnert | 165/61 |
| 5,434,378 | 7/1995 | Heine et al. | 165/61 |

FOREIGN PATENT DOCUMENTS

| | | | |
|---|---|---|---|
| 0765248 | 6/1934 | France | 62/446 |
| 642901 | 3/1937 | Germany . | |
| 731735 | 2/1943 | Germany . | |
| 1734642 | 11/1956 | Germany . | |
| 1019663 | 11/1957 | Germany . | |
| 1045430 | 12/1958 | Germany . | |
| 1908227 | 2/1969 | Germany . | |
| 4116500A1 | 11/1992 | Germany . | |
| 0327701 | 7/1935 | Italy | 62/446 |
| 2195181 | 8/1990 | Japan | 62/446 |
| 0859518 | 1/1961 | United Kingdom | 165/64 |
| 2135035 | 8/1984 | United Kingdom . | |

*Primary Examiner*—Edward K. Look
*Assistant Examiner*—Mark Sgantzos
*Attorney, Agent, or Firm*—Popham Haik Schnobrich & Kaufman, Ltd.

[57] ABSTRACT

A laboratory refrigerator, in particular a refrigerated incubator, in which an inner basin surrounding the useful storage volume is surrounded by an outer basin. The air in the useful storage volume is circulated via a chamber formed between the inner basin and the outer basin and re-enters the useful storage volume via apertures in the side walls of the inner basin. Heating elements are provided in the chamber for controlling the temperature of the circulating air and labyrinthine plate evaporators are provided on the outside of the side walls of the outer basin.

9 Claims, 2 Drawing Sheets

FIG. 1
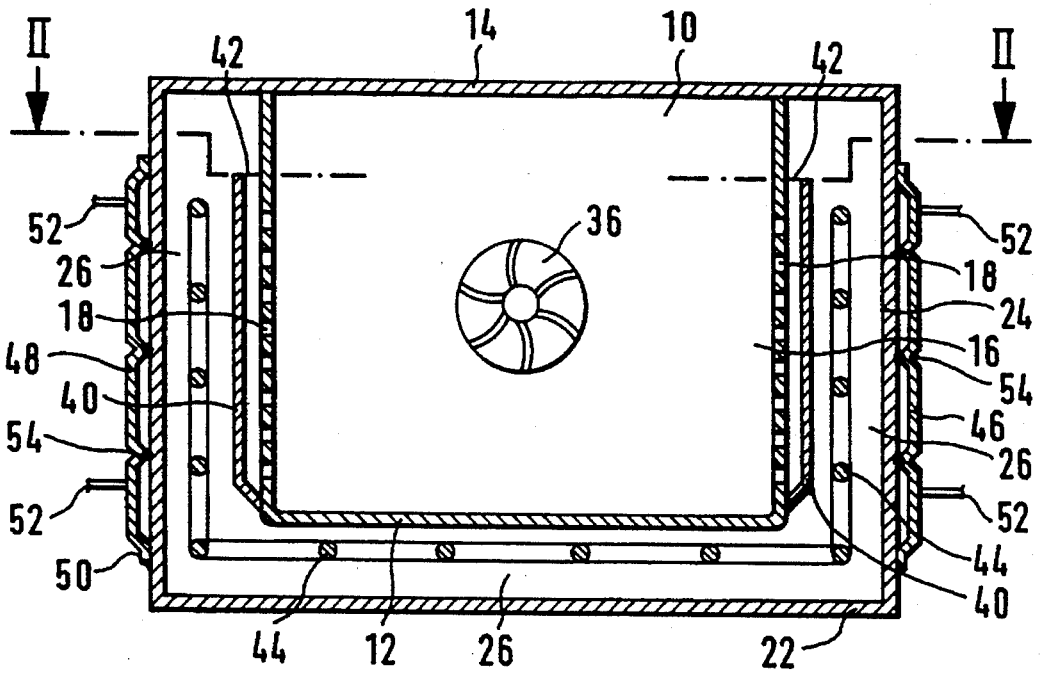
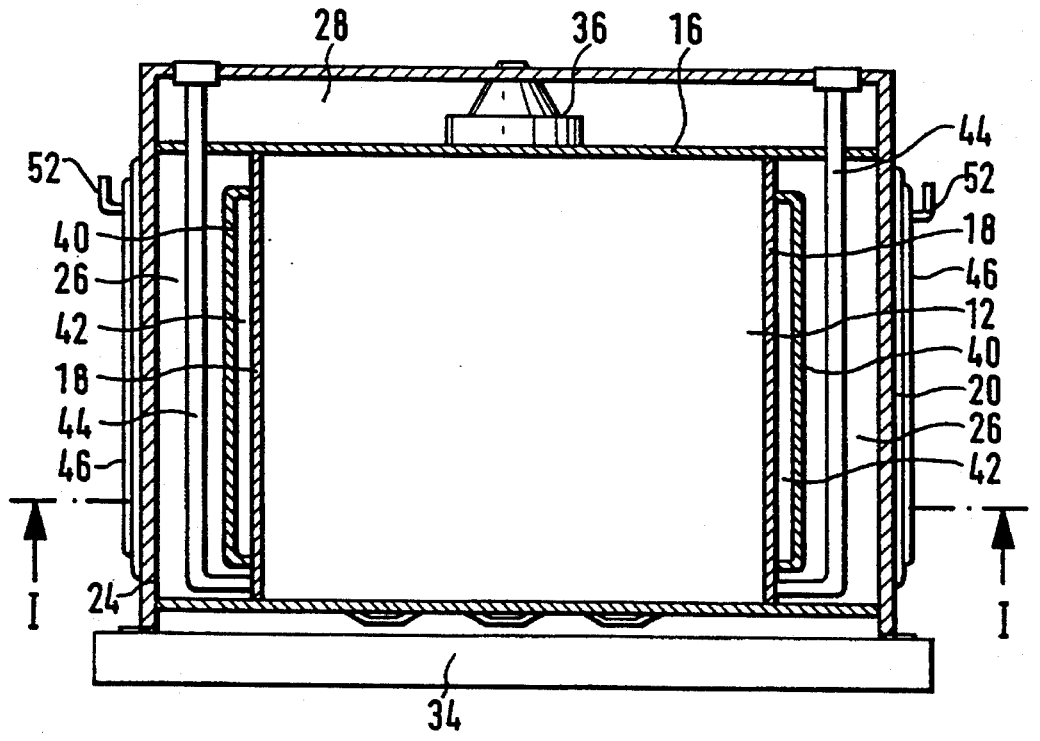
FIG. 2

LABORATORY REGRIGERATOR, IN PARTICULAR A REFRIGERATED INCUBATOR

BACKGROUND OF THE INVENTION

1. Field of the Invention

The present invention relates to a laboratory refrigerator, in particular a refrigerated incubator having temperature control for the circulating air, comprising an inner basin defining a useful storage volume, an outer basin surrounding the inner basin and forming a chamber therebetween, with the air being removed from the useful storage volume by means of a fan, the temperature being controlled in the chamber and conveyed back into the useful storage volume via apertures in the walls of the inner basin, and a refrigerating unit, the evaporator of which is supplied with the circulating air.

2. Description of the Related Art

In a known refrigerated incubator of this type, the air of the useful storage volume is circulated by means of a fan via a chamber formed between the inner basin and the outer basin. In order to regulate the temperature of the air, firstly heating elements and secondly the evaporator of a refrigerating unit are provided in this chamber.

In such known incubators the evaporator is constructed as a finned evaporator around which the circulating air flows. The fins of the finned evaporator provide a large surface for heat-exchange in order to provide for effective cooling of the circulating air. However, the tight arrangement of the fins complicates cleaning, which may be particularly problematical if biological material treated in the refrigerated incubator is spilt. The sharp-edged fins also represent a risk of injury during cleaning. In addition, condensation may occur, in particular on the pipes of the finned evaporator, resulting in the circulated air being dehumidified, which is undesirable. Moreover, as the finned evaporators only have a relatively small thermal capacity, their temperature displays relatively large variations, which in turn results in temporal and spatial inaccuracies in the temperature of the air in the useful storage volume.

In order to avoid the dehumidification of air in the useful storage volume, it is known to surround the useful storage volume with a closed jacket, in which the air is subject to temperature regulation and is circulated (e.g. refrigerated incubator BK 6160 of the company Heraeus). As no exchange of air occurs between the useful storage volume and the jacket, the air in the useful storage volume does not come into direct contact with the evaporator of the refrigeration unit and hence is only slightly dehumidified.

In this known refrigerated incubator only the air in the jacket surrounding the useful storage volume is subject to direct temperature regulation. The air in the useful storage volume is only subject to temperature regulation by thermal exchange with the air in the jacket via the wall of the inner basin. This provides poor energy transmission between the evaporator or respectively the heating elements and the air in the useful storage volume, so that the temperature regulation in the useful storage volume is sluggish. When the door of the refrigerated incubator is opened, such long recovery times ensue that it is scarcely possible to store the material in the refrigerated incubator under undisturbed temperature conditions.

SUMMARY OF THE INVENTION

An object of the present invention is to provide a laboratory refrigerator, in particular a refrigerated incubator, in which effective cooling, only a slight dehumidification, and a high level of temperature accuracy and temperature constancy of the air of the useful storage volume are combined.

Accordingly, the present invention provides a laboratory refrigerator, in particular a refrigerated incubator with circulating air temperature control, comprising an inner basin defining a useful storage volume, an outer basin surrounding the inner basin and forming a chamber therebetween, with the air being removed from the useful storage volume by means of a fan, the temperature being controlled in the chamber and conveyed back into the useful storage volume via apertures in the walls of the inner basin, and a refrigerating unit, the evaporator of which is supplied with the circulating air and which is constructed as at least a plane plate evaporator, which in the region of the chamber is disposed in plane heat-conductive contact with the outer side of the outer basin and is formed by the outer basin and a sheet welded to the outer side of the outer basin.

In a refrigerator in accordance with the present invention, in which the air in the useful storage volume is circulated for temperature control via a chamber formed between the inner basin and the outer basin, an essential concept of the invention lies in mounting the evaporator of the refrigerating unit as a plane labyrinthine plate evaporator on the outer side of the outer basin. In the chamber the circulated air flows over a large area along the outer basin in thermal contact with the plate evaporator, so that a large heat exchange surface having a good heat transmission is produced. A relatively small temperature difference between the circulating air and the evaporator is sufficient for the required energy transport on account of the large heat exchange surface and the good heat transmission. Therefore, the dew point at the inside of the outer basin which comes into contact with the circulating air is not reached, with the result that the circulated air is only very slightly dehumidified. The plate evaporator has a large volume and a large thermal capacity. Accordingly, only slight temperature variations in the heat exchange surface occur, from which a high level of accuracy and constancy of the air temperature result.

As the labyrinthine plate evaporator is disposed on the outer side of the outer basin, the inner side of the outer basin can be constructed without edges or corners, with the result that the outer basin can be easily and optimally cleaned when the inner basin has been removed.

In a preferred embodiment, the labyrinthine plate evaporator is formed by a sheet welded onto the outer side of the outer basin. Consequently, the outer basin itself forms the inner plate of the plate evaporator. As a result, in particular an optimal heat transmission from the circulating air flowing through the chamber to the evaporator is achieved, in addition to a reduction in the manufacturing costs.

In a preferred embodiment, the refrigerator is a refrigerated incubator, which apart from the plate evaporator, is substantially constructed as known from German Patent Specification No 41 16 500 for a laboratory warming cabinet. In that design the circulated air enters via apertures in the side walls of the inner basin into the useful storage volume. Labyrinthine plate evaporators are mounted on the side walls of the outer basin. Air baffle plates covering the apertures in the side walls of the inner basin ensure that the circulating air has to flow completely along the heating elements disposed in the chamber and along the plate evaporators before the air can reach the apertures in the side walls of the inner basin and re-enter the useful storage volume. As a result, with a space-saving, compact structure, it is ensured that the entire volume of circulating air flowing back into the useful storage volume has to flow completely past the heating elements and the heat exchanger surfaces of the plate evaporator and temperature regulation is performed in the same way.

Of course, it will be understood that in addition to the plate evaporators mounted on the side walls, a further plate evaporator may also be provided oh the outer side of the base of the outer basin, or alternatively only a single plate evaporator may be provided on the outer side of the base.

BRIEF DESCRIPTION OF THE DRAWINGS

A preferred embodiment of the present invention will now be described by way of example only with reference to the accompanying drawings, in which:

FIG. 1 shows a front view of an inner basin and an outer basin of a refrigerated incubator in vertical section along line I—I of FIG. 2;

FIG. 2 shows a horizontal section along line II—II of FIG. 1;

DETAILED DESCRIPTION OF THE PREFERRED EMBODIMENT

Figure 3:
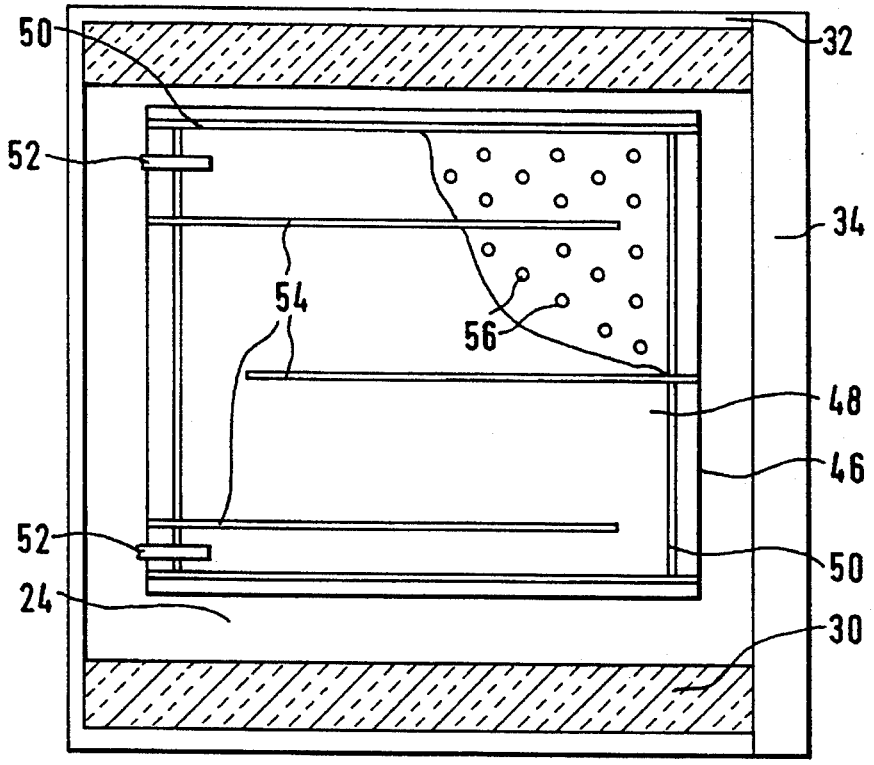
FIG. 3 shows a side view of the refrigerated incubator of FIG. 1, with the outer housing and thermal insulation removed.
Figure 4:
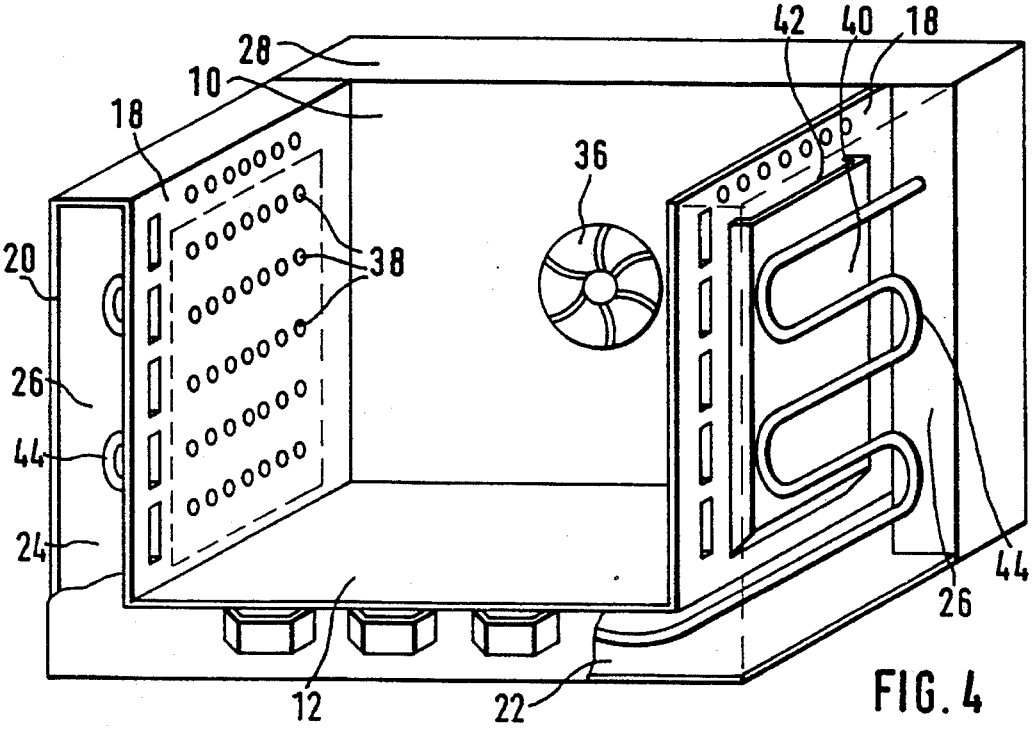
FIG. 4 shows a perspective view of inner and outer basins of the refrigerated incubator of FIG. 1, with the outer basin shown in part section.

The refrigerated incubator comprises an inner basin 10 made of high-grade steel surrounding the useful storage volume, which has the shape of a cuboid with rounded edges and corners. The inner basin 10 consists of a base 12, a cover 14, a rear wall 16 and side walls 18. The front side is open, so as to provide access to the useful storage volume.

An outer basin 20 of U-shape, which is preferably also made of high-grade steel, surrounds the base and side walls of the inner basin 10. The base 22 and the side walls 24 of the outer basin 20 are spaced from the base 12 and the side walls 18 of the inner basin 10, so that a U-shaped chamber 26 surrounding the inner basin 20 is formed between the inner basin 10 and the outer basin 20. The chamber 26 is closed at the front end face. An ante-chamber 28, which closes the rear end face of the chamber 26, is disposed behind the rear wall 16 of the inner basin 10.

The outer basin 20 is surrounded by thermal insulation 30. An outer housing 32 surrounds the entire refrigerated incubator. The front side of the refrigerated incubator is closed by a thermally insulating door 34.

A fan 36 is disposed in the ante-chamber 28 behind an aperture in the rear wall 16 of the inner basin 10. The ante-chamber 28 opens to the chamber 26 at the region lying beneath the base 12 of the inner basin 10. Apertures 38, which produce a connection between the chamber 26 and the useful storage volume, are provided (distributed in a grid pattern) in the side walls 18 of the inner basin 10. An air baffle plate 40 is mounted on the outer side of each of the side walls 18 of the inner basin 10, parallel to the respective side wall 18 and spaced therefrom. Each air baffle plate 40 is attached at its lower edge and two vertical side edges in sealed manner to the respective side wall 18, so that an inlet gap 42 remains open between each respective air baffle plate 40 and side wall 18 only at the upper edge of the air baffle plates 40.

The fan 36 circulates the air in the useful storage volume. For this purpose the fan 36 sucks the air out of the useful storage volume of the inner basin 10 into the ante-chamber 28. After leaving the ante-chamber 28 the circulating air enters the base region of the chamber 26 and flows upwardly from the base region at both sides of the inner basin 10 in the chamber 26. At the top of the chamber 26 the circulating air may then pass via the inlet gap 42 between the respective side walls 18 and the air baffle plates 40 and re-enters the useful storage volume of the inner basin 10 via the apertures 38.

Electric heating elements 44, which extend preferably in a meandering fashion over the base region and the two vertical side regions of the chamber 26, are provided in the chamber 26.

Labyrinthine plate evaporators 46 of a refrigerating unit (not represented) are disposed on the outer side of the side walls 24 of the outer basin 20. The plate evaporators 46 extend over the entire surface of the side walls 24 or at least over the largest possible surface region of the side walls 24. The plate evaporators 46 are formed by the side wall 24 of the outer basin 20 as the inner plate and a sheet 48 welded onto the outside of the side wall 24 as the outer plate. The rectangular sheet 48 corresponding to the side wall 24 is tightly connected to the side wall 24 by a rolled seam weld 50 running around its edge. Connecting branches, which serve to supply and convey away the evaporator refrigerant, are tightly welded at the top and bottom to the vertical rear edge of each plate evaporator 46. In order to convey the evaporator refrigerant as uniformly as possible over the entire surface of the plate evaporator 46, further horizontal rolled seam welds 54 are provided, which extend alternately from the vertical rear edge and the vertical front edge of the sheet 48 right up to the rolled seam weld 50 of the respective opposite edge, as can clearly be seen from FIG. 3. The horizontal rolled seam welds connect the sheet 48 tightly with the side wall 24, so that a meander-shaped labyrinthine path is produced for the evaporator refrigerant between the upper and the lower connection branches 52. In order to distribute the refrigerant of the evaporator uniformly over the surface of the side wall 24, even in the region of this meandering path, indentations 56 can be additionally provided in the sheet 48, which are distributed in a uniform grid-like pattern over the sheet 48, as is shown by way of example in FIG. 3 in the right upper corner of sheet 48. The indentations 56 in the sheet 48 abut the side wall 24 and if necessary may also be connected to the side wall 24 by spot welding.

The air of the useful storage volume circulated by the fan 36 flows through the chamber 26 for temperature control. The air baffle plates 40 guarantee that the entire volume of circulated air in the chamber 26 has to flow completely along the entire length of the heating elements 44 and along the entire heat exchange surface of the plate evaporators 46 formed at the side walls 24, before the circulating air arrives back in the useful storage volume of the inner basin 10 via the inlet gap 42 and the apertures 38.

What is claimed is:

1. A refrigerated laboratory incubator with circulating air temperature control, comprising:

an inner basin defining a useful storage volume, the inner basin including rear and side walls, at least one of the walls having apertures therein leading into the useful storage volume for conveying air into the useful storage volume;

an outer basin surrounding the inner basin and forming a chamber therebetween for retaining a circulating volume of air, the outer basin including an outer side;

a fan positioned exterior to the inner basin for removing air from the useful storage volume;

a refrigerator unit including at least one plate evaporator supplied with circulating air and having a heat exchanger surface, the at least one plate evaporator being formed by a portion of the outer side of the outer basin and a sheet affixed to and in plane heat-conductive contact with the portion of the outer side.

2. A laboratory incubator according to claim 1, wherein the at least one plate evaporator is constructed as a labyrinthine plate evaporator having a meandering refrigerant flow path.

3. A laboratory incubator according to claim 1, further comprising means for conveying the volume of circulating air in the chamber along the heat exchanger surface of the at least one plate evaporator before arriving at the apertures leading into the useful storage volume.

4. The laboratory incubator according to claim 3, wherein the sheet includes an inner surface, and wherein the at least one plate evaporator further includes a plurality of spaced rolled seam welds connecting the inner surface of the sheet to the outer basin, the plurality of spaced rolled seam welds defining the meandering refrigerant flow path.

5. A laboratory incubator according to claim 4, wherein between the rolled seam welds, the sheet is provided with indentations which abut the outer basin and which are distributed in a grid pattern.

6. A laboratory incubator according to claim 1, wherein:

the outer basin includes side wails opposite the side walls of the inner basin, the side walls having outer surfaces defining at least a portion of the outer side of the outer basin;

there are two of the plate evaporators, the plate evaporators being disposed on the outer surfaces of the side walls;

the apertures are disposed in the side walls of the inner basin; and the laboratory incubator further comprises an air baffle plate spaced apart from and parallel to a corresponding side wall of the inner basin facing one of the side walls of the outer basin, each of the air baffles screening the apertures in the corresponding side wall, each air baffle plate having an outlet end and being mounted to the corresponding side wall with only the outlet end open to the flow of circulating air.

7. A laboratory incubator according to claim 6, wherein the heating elements are positioned between the air baffle plates and the outer basin.

8. The laboratory incubator according to claim 1, further comprising heating elements provided in the chamber, the heating elements being spaced from both the inner and outer basins.

9. The laboratory incubator according to claim 1, wherein the sheet has an outer periphery and a circumferential rolled seam weld at the outer periphery tightly connecting the sheet to the outer basin.

* * * * *